United States Patent [19]

Ward et al.

[11] 4,137,132

[45] Jan. 30, 1979

[54] CHROMITE COATINGS, ELECTROLYTES, AND ELECTROLYTIC METHOD OF FORMING THE COATINGS

[75] Inventors: John J. B. Ward; Clive Barnes, both of Wantage, England

[73] Assignee: BNF Metals Technology Centre, Wantage, England

[21] Appl. No.: 802,193

[22] Filed: May 31, 1977

[30] Foreign Application Priority Data

Jun. 1, 1976 [GB] United Kingdom ..... 22686/76

[51] Int. Cl.$^2$ ..... C25D 11/38

[52] U.S. Cl. ..... 204/38 R; 204/38 S; 204/56 R; 148/6.2; 148/6.21

[58] Field of Search ..... 204/56 R, 38 S, 38 R; 106/1; 148/6.2, 6.21

[56] References Cited

U.S. PATENT DOCUMENTS

| | | | |
|---|---|---|---|
| 2,733,199 | 1/1956 | Wick | 204/56 R |
| 3,032,487 | 5/1962 | Yonezaki et al. | 204/56 R |
| 3,337,431 | 8/1967 | Kitamura et al. | 204/56R |

FOREIGN PATENT DOCUMENTS

| | | | |
|---|---|---|---|
| 710309 | 5/1965 | Canada | 204/56 R |
| 1179021 | 1/1970 | United Kingdom | 204/56 R |

OTHER PUBLICATIONS

Chromium Plating by Morisset et al., 1954, p. 81.

*Primary Examiner*—R. L. Andrews
*Attorney, Agent, or Firm*—Wenderoth, Lind & Ponack

[57] ABSTRACT

A method of producing chromium conversion coatings is described. The coatings are novel in that they are chromite i.e. $Cr_2O_3$ coatings rather than the conventional chromate i.e. $CrO_3$ coatings. The invention includes a novel electrolyte for depositing chromite layers. The electrolyte is an aqueous solution containing $Cr^{III}$ions, a weak complexing agent for $Cr^{III}$ions and a poison for the electrodeposition of chromium metal. The electrolyte preferably also contains conductivity salts and may include other additives such as fluoride ion and boric acid. Examples of poisons are $Cr^{VI}$ions, peroxide, nitrate, polyamines, phosphates and formaldehyde. The chromite conversion coatings can be improved by aging and can be subsequently painted or lacquered. The electrolytes of the present invention are much less corrosive than $Cr^{VI}$ electrolytes and thus the substrates which can be coated include materials which cannot readily be chromate coated because they are reactive towards $Cr^{VI}$ electrolytes.

26 Claims, No Drawings

CHROMITE COATINGS, ELECTROLYTES, AND ELECTROLYTIC METHOD OF FORMING THE COATINGS

The present invention relates to the deposition of corrosion resistant coatings on metal substrates and particularly to a method of depositing protective coatings containing $Cr_2O_3$.

It is known that protective layers of chromium oxides can be electrodeposited onto metal substrates to improve corrosion resistance. Such layers are known as chromium conversion coatings. At present, the production of chromium containing conversion coatings is carried out under acid conditions from a $Cr^{VI}$ electrolyte containing sulphuric or nitric acids. Sulphuric acid gives yellow coatings and nitric acid colourless or slightly blue coatings; however, the coatings deposited from sulphuric acid are more corrosion resistant than the nitric acid ones. These coatings contain $Cr^{VI}$ and are also known as 'cromate' coatings.

We have previously shown that it is possible to electrodeposit highly satisfactory layers of chromium from trivalent chromium electrolytes. We have now found that by deliberately suppressing the deposition of chromium metal from a $Cr^{III}$ electrolyte it is possible to deposit nonmetallic layers containing $Cr_2O_3$ having both excellent transparency and corrosion resistance. We refer to such coatings as 'chromite' coatings or deposits because we believe that they contain no $Cr^{VI}$.

The present invention accordingly provides an aqueous electrolyte for the electrodeposition of protective chromite deposits comprising $Cr^{III}$ ions, a weak complexing agent for $Cr^{III}$ ions, preferably one or more conductivity salts and a poison for the cathodic reduction of $Cr^{III}$ to $Cr^{o}$.

The invention also provides a method of depositing a protective chromite layer on a substrate which method comprises providing an anode and as a cathode the substrate to be coated in an electrolyte of the invention and passing an electric current between the anode and cathode whereby a protective chromite layer is deposited on the cathode.

The concentration of $Cr^{III}$ ions, in the electrolyte will generally be in the range from 0.02 molar (1 $gl^{-1}$ as Cr) to saturation. However, with less than 0.1 molar (5 $gl^{-1}$) chromite deposition cannot be effected reliably and this concentration represents a practically useful minimum. There is no specific upper limit short of saturation, but possible crystallization problems at concentration approaching saturation should be considered. There is little gain in using concentrations higher than 2 molar (100 $gl^{-1}$) and this may be regarded as a practical economic maximum. The generally preferred range is from 0.1 to 1.2 molar (5 $gl^{-1}$ to 60 $gl^{-1}$). The optimum concentration within this range will depend on the precise operating conditions, and the practical economic optimum will generally be a compromise between maximum deposition rate favoured by relatively higher concentrations, and capital costs and losses such as dragout losses which favour lower concentrations.

The nature of the weak complexing agent is not especially critical. A weak complexing agent is one which forms a coordination complex with $Cr^{III}$ sufficiently strong to maintain the chromium in solution in the electrolyte but not so strong as to prevent deposition of chromium from the electrolyte under the influence of an electric current. Suitable materials include hypophosphite, glycine, gluconolactone, glycollic acid, acetate, citrate and formate. The aprotic buffers such as dimethylformamide which are useful in chromium metal electrodeposition systems are not generally preferred in the present invention. The amount of the weak complexing agent is sufficient to keep the $Cr^{III}$ in solution. The concentration of the complexant should not be less than 0.5 times that the $Cr^{III}$ on a molar basis because lower concentrations are generally inadequate to keep $Cr^{III}$ in solution during electrolysis, and is preferably not more than 6 times that of the $Cr^{III}$ (on a molar basis) because there is little if any improvement in performance and the cost is increased. The preferred concentration is within the molar ratio of complexant: $Cr^{III}$ of 0.5:1 to 3:1 with the precise optimum for any particular system depending on the complexing agent used.

Boric acid can be included in the electrolyte generally at concentrations of from 1 $gl^{-1}$ up to saturation. Preferably the concentration is between 20 and 50 $gl^{-1}$.

It is preferred to ensure that the conductivity of the electrolyte is high since this reduces ohmic losses. To this end conductivity salts may be added to the electrolyte. Suitable salts include those containing cations such as $NH_4^+$, $K^+$, $Na^+$, $Mg^{2+}$ and $Ca^{2+}$ and anions such as halide, especially $Cl^-$ and $SO_4^{2-}$. The concentration used clearly depends on solubility but as a general rule a practical minimum concentration is 0.5 molar and the maximum is limited by saturation solubility and in practice is about 6 molar. However, especially where ammonium chloride and/or sulphate are used as conductivity salts higher concentrations are possible. The preferred range of concentrations of the conductivity salts is from 2 to 6 molar.

The anion present in the electrolyte will, as indicated above, usually be halide and/or sulphate. The anion may be uniform or a mixture e.g. of chloride and sulphate. Generally halides (chlorides) are more soluble but sulphates, especially chromic sulphate, more readily available.

The agents which can be added to the electrolyte to inhibit the deposition of chromium metal fall into three classes:

(a) Oxidizing agents

To be useful the oxidizing agent should be one having a reduction potential less than that of the reaction $Cr^{III} \xrightarrow{3e} Cr^{0}$. However, simple oxidizing metal ions are not suitable since they often result in the deposition of alloys rather than inhibition of chromium deposition. Suitable oxidizing agents include $H_2O_2$, or peroxy acid salts, chromic acid and $Cr^{VI}$ ions, and nitrate ions. We believe that this kind of poison acts by being electroreduced at the cathode in preference of $Cr^{III}$. The oxidizing agent is thus consumed at the cathode. It is possible by the choice of a suitable material for the anode to re-form the oxidizing agent by anodic oxidation. Of particular interest in this respect is the use of a lead anode where the oxidizing agent is $Cr^{VI}$. At the cathode the $Cr^{VI}$ is electro-reduced to $Cr^{III}$ which can be re-oxidized to $Cr^{VI}$ at a lead anode. Indeed, it is possible to form $Cr^{VI}$ in situ in a $Cr^{III}$ electrolyte and thus poison metal deposition by using a lead anode. However, if $Cr^{VI}$ is introduced into the electrolyte in this way there is an induction period whilst the $Cr^{VI}$ is formed during which metal deposition is not specifically inhibited.

(b) $H_2$ overvoltage reducers

These agents work by either directly reducing the overvoltage for cathodic $H_2$ evolution or by increasing the potential required to reduce $Cr^{III}$ to $Cr^{O}$. We have found two sorts of compound within this type. The first sort is polyamines especially diamines such as ethylene diamine and hexamine. These seem to work by forming a layer at the cathode having a pH too high to allow Cr deposition. The second sort are phosphates especially dihydrogen phosphates. These probably form chromium phosphates near the cathode thus preventing deposition of Cr metal.

(c) Formaldehyde

Formaldehyde acts to inhibit electrodeposition of Cr metal. We do not know the mechanism by which it operates and cannot suggest a complete explanation. The result is entirely unexpected and highly surprising because from our previous work on $Cr^{III}$ electrolytes we would have expected that it would behave in a similar fashion to dimethylformamide as a dipolar aprotic buffer. Formaldehyde does not act as a buffer but acts to inhibit Cr deposition. We have found that formaldehyde reduces the overvoltage for $H_2$ evolution as compared with Cr deposition, but this would not appear to be sufficient to explain the effectiveness of formaldehyde.

The concentration of the poisoning agent added is preferably at least 1 $gl^{-1}$. The amount actually used depends on the circumstances but the effect of adding the poison is to increase the threshold current density (CD) at which Cr metal is deposited. 1 $gl^{-1}$ generally produces a significant rise in the threshold CD and amounts more than about 15 $gl^{-1}$ do not produce any significant further rise (Cr metal deposition being virtually totally suppressed at all current densities). The preferred range is from 2 $gl^{-1}$ to 10 $gl^{-1}$, although usually the poison will be used in excess over the minimum necessary because it may be consumed at the cathode.

The anode used in the electrolysis is not critical. Carbon anodes and other inert anodes are generally satisfactory and it is possible to use chromium anodes. With carbon anodes in halide especially chloride, electrolytes it is desirable to agitate the electrolyte in the vicinity of the anode e.g. mechanically or by sparging air, to assist with suppressing evolution of halogen at the anode. As is mentioned above, it is possible and may be desirable to use or include a lead anode to permit regeneration of an oxidizing agent type of poison especially chromic acid ($Cr^{VI}$). However, when lead anodes are used it is not desirable to use readily oxidized complexants e.g. hypophosphite which would be oxidized to phosphate, although complexants which are not readily oxidizable such as glycine can be used. Further, because of the relative solubility of lead halides, lead anodes are only really useful in solely sulphate baths.

The pH of operation of the electrolytes is generally from 1 to 5 which is very similar to that used in Cr electrodeposition from $Cr^{III}$ electrolytes. However, as is mentioned above, in connection with polyamines the pH at or near the cathode may be rather higher. The temperature of operation is not generally critical, temperatures up to 55° C. being suitable. Slightly superambient temperatures are preferred and suitable temperatures can be achieved by ohmic heating of the electrolyte. Temperatures above about 35° C. generally require external heating and at temperatures higher than 55° C. evaporation of water tends to become a problem.

The current density range over which chromite coatings can be deposited is generally from 10 to $10^4$ $Am^{-2}$. As is indicated above, the precise range may be determined by the amount of poison added. At current densities within this range and using electrolysis times typically of from 10 seconds to 5 minutes chromite coatings from 100 Angstroms to 1.0 microns thick can be deposited. Preferably the conditions are adjusted to give a thickness of from 0.025 to 1 and optimally from 0.1 to 1 micron. The minimum thickness of any deposit depends on the shape of the article as reflected in the localized current density together with the period of time of the electrolysis.

The substrates which can usefully be coated according to the invention are basically the same as those which are conventionally treated in $Cr^{VI}$ systems. However, the present invention makes use of electrolytes which are markedly less corrosive than typical $Cr^{VI}$ electrolytes and it thus becomes possible to coat substrates which would be too susceptible to corrosion in a $Cr^{VI}$ electrolyte. Typical substrates include steel, especially tin-free steel, zinc, brass, copper, nickel, tin, alloyed gold (pure gold being sufficiently corrosion resistant not to require coating), silver, cadmium, chromium, especially sealing porous electrodeposits, stainless steel, especially coloured stainless steel, and possibly cobalt and aluminium (although it is more usual to anodize Al).

Freshly deposited films are often slightly porous and easily removed from the substrate by mild abrasion. Air drying at ambient temperature for not less than 24 hours seals the films causing structural changes which also harden the films making them more resistant to mechanical abrasion. These beneficial sealing effects can be accelerated by drying at superambient temperatures but if the temperature is allowed to exceed 75° C. the films can become brittle which lessens their protective value.

The clear films of this invention when deposited on the abovementioned substrates may also serve as a primer coating for the deposition of subsequent coatings of paint or lacquer. The oxide film secures enhanced adhesion of the paint or lacquer coating. Moreover, the oxide film provides additional protection against corrosion by suppressing underfilm corrosion of paint or lacquer layers.

The following Examples illustrate the invention.

EXAMPLE 1

0.7M Cr (as sulphate)
4M $NH_4^+$ 0.4M Boric acid
0.7M Sodium hypophosphite
pH = 3.0
Temp = 30° C.

Constituted as above, the operated as an electrolyte, as 1000 $Am^{-2}$ cathode current density, decorative chromium plate was deposited. 5 $gl^{-1}$ sodium dehydrogen phosphate was added to the electrolyte. No chromium metal was deposited at any current density and careful examination revealed the presence of a transparent film. A variety of substrate metals were cathodically treated at 200 $Am^{-2}$ for one minute in this solution. The results were as follows:

| Test | Substrate | | Result |
|---|---|---|---|
| Immersion in polysulphide solution for 5 minutes | Copper | untreated | immediate blackening |
| | | cathodically filmed | retained original appearance |
| Exposed to humid corrosive environment for 3 months | Nickel | untreated | became dull and tarnished |
| | | cathodically filmed | retained original appearance |
| Immersed in polysulphide solution | Silver | untreated | Yellowed |
| | | cathodically | retained original |

-continued

| Test | Substrate | Result |
|---|---|---|
| for 15 minutes | filmed | appearance |

The same corrosion tests were performed on films obtained after 2 and 4 minute electrolysis and at current densities of 100 $Am^{-2}$ and 400 $Am^{-2}$. Similar results were obtained in all cases.

EXAMPLE 2

As Example 1, but with 2 $gl^{-1}$ chromic acid instead of sodium dihydrogen phosphate. Clear films obtained at current densities up to 1000 $Am^{-2}$, above this current density, chromium was deposited. The concentration of chromic acid was increased to 5 $gl^{-1}$ no chromium was deposited at any current density and films were obtained. The films possessed similar corrosion resistance to those of Example 1.

EXAMPLE 3

As Example 1 but with 10 $gl^{-1}$ hexamine in place of sodium dihydrogen phosphate. Identical results to Example 1.

EXAMPLE 4

As Example 1 but with 20 ml $l^{-1}$ of 40% formaldehyde solution in place of sodium dihydrogen phosphate. Identical results to Example 1.

EXAMPLE 5

1.0M chromic chloride
1.0M ammonium sulphate
2.0M ammonium chloride
0.8M boric acid
1.0M sodium hypophosphite
3 $gl^{-1}$ sodium nitrate
pH = 3.5
temp = 25° C.

Clear films were obtained at all current densities. The films possessed similar corrosion resistance to those of Example 1.

EXAMPLE 6

0.8M chromic sulphate ("as chrometan")
1.0M sodium hypophosphite
3 $gl^{-1}$ sodium nitrate
pH = 2.8
temp = 30° C.

Hull cell panel plated at 10A for 1 min., voltage across cell = 21V. Clear film obtained at all current densities. 165 $gl^{-1}$ (3M) ammonium chloride added to electrolyte. Another 10A Hull cell panel plated, voltage = 11V. Clear film obtained at all current densities.

EXAMPLE 7

1.0M chromic sulphate (as "chrometan")
3.0M ammonium chloride
0.5M ammonium fluoride
1.2M sodium formate
0.5M boric acid
5 $gl^{-1}$ ammonium nitrate Clear films obtained at all current densities. The films possessed the same corrosion resistance of those of Example 1.

EXAMPLE 8

With an electrolyte of Example 1, copper panels were cathodically treated at 200 $Am^{-2}$ for 30 seconds. Immersion in polysulphide solutions caused the copper to slowly blacken. Other copper panels, cathodically treated in the same way were oven dried at 50° C. for 16 hours. No blackening occurred when immersed in a polysulphide solution.

EXAMPLE 9

Copper panels were cathodically treated in an electrolyte of Example 1 at a current density of 200 $Am^{-2}$ for a time of 1 minute. After drying, the panels were sprayed with a clear lacquer. When the lacquer was dry one panel was cut in half. Examination showed that there was no flaking of the lacquer along the edges of the cut. For comparison, a copper panel was sprayed directly with lacquer. After cutting in half, some microflaking of the lacquer was detected.

Other copper panels, prepared as described above, were scribed to give a single long scratch penetrating to the copper. The panels were exposed to a humid, corrosive environment. After one month panels with the cathode film plus lacquer only showed corrosion along the length of the scratch. Lacquered panels without the cathode film showed corrosion spreading from the scratch underneath the lacquer.

We claim:

1. An aqueous trivalent chromium electrolyte for the disposition of protective chromite deposits consisting apart from water essentially of:

(i) $Cr^{III}$ ions in a concentration of from 0.1 to 2 molar;
(ii) a weak complexing agent for $Cr^{III}$ ions selected from the group consisting of hypophosphite, glycine, gluconolactone, glycolic acid, acetic acid, citric acid, and formic acid said complexing agent being present in a molar concentration of at least 0.5 times that of the $Cr^{III}$ ion present;
(iii) a conductivity salt in a concentration of at least 0.5 molar; and
(iv) as the sole poison for the cathodic reduction of $Cr^{III}$ to $CR^0$, a member selected from the group consisting of $H_2O_2$, peroxy acid salts, nitrate ions, a polyamine, a phosphate and formaldehyde, said poison being present in a concentration of at least 1 $gl^{-1}$.

2. A method of depositing a protective chromite layer on a substrate which method comprises providing an anode and as a cathode the substrate to be coated in an electrolyte as claimed in claim 1 and passing an electric current between the anode and cathode whereby a protective chromite layer is deposited on the cathode.

3. A method as claimed in claim 2 including the subsequent step of aging the chromite coating.

4. A method as claimed in claim 3 including the subsequent step of painting or lacquering the deposit.

5. A method as claimed in claim 2 wherein the anode is of carbon or other inert material.

6. A method as claimed in claim 2 wherein the pH of the electrolyte is from 1 to 5, the temperature is up to 55° C., and wherein the chromite coating is deposited at a current density of from 10 to $10^4$ $Am^{-2}$ by passing the electric current for a time of from 10 seconds to 5 minutes.

7. A method as claimed in claim 2 wherein the substrate is selected from the group steel, zinc, brass, copper, nickel, tin, alloyed gold, silver, cadmium, chromium and stainless steel.

8. A method as claimed in claim 2 wherein the chromite coating is from 100 Angstroms to 1 micron thick.

9. An electrolyte as claimed in claim 1 containing one or more conductivity salts including at least one cation selected from the group $NH_4^+$, $K^+$, $Na^+$, $Mg^{2+}$ and $Ca^{2+}$ and at least one anion selected from the group halide and $SO_4^{2-}$ at a concentration of at least 0.5 molar.

10. An electrolyte as claimed in claim 1 wherein the concentration of the conductivity salt or salts is from 2 to 6 molar.

11. An electrolyte as claimed in claim 1 wherein the molar ratio of the concentration of the weak complexing agent to $Cr^{III}$ ions is from 0.1:1 to 6:1.

12. An electrolyte as claimed in claim 1 containing boric acid at a concentration of from 1 $gl^{-1}$ to saturation.

13. An electrolyte as claimed in claim 1 wherein the concentration of the poison is from 1 to 15 $gl^{-1}$.

14. An aqueous trivalent chromium electrolyte for the deposition of protective chromite deposits consisting apart from water essentially of:

(i) $Cr^{III}$ ions as chromic sulphate in a concentration of from 0.1 to 2 molar;

(ii) glycine, as the sole weak complexing agent for the $Cr^{III}$ ions, in a molar concentration of at least 0.5 times that of the $Cr^{III}$ ions present;

(iii) a sulphate conductivity salt in a concentration of at least 0.5 molar; and (iv) $Cr^{VI}$ ions or chromic acid, as a poison for the cathodic reduction of $Cr^{III}$ to $Cr^{\circ}$, in a concentration of at least 1g $1^{-1}$.

15. A method of depositing a protective chromite layer on a substrate which method comprises providing a lead anode and as a cathode the substrate to be coated in an electrolyte as claimed in claim 14 and passing an electric current between the anode and the cathode whereby a protective chromite coating is deposited on the cathode.

16. A method as claimed in claim 15 including the subsequent step of aging the chromite coating.

17. A method as claimed in claim 16 including the subsequent step of painting or lacquering the deposit.

18. A method as claimed in claim 15 wherein the anode is of carbon or other inert material.

19. A method as claimed in claim 15 wherein the pH of the electrolyte is from 1 to 5, the temperature is up to 55° C., and wherein the chromite coating is deposited at a current density of from 10 to $10^4$ $Am^{-2}$ by passing the electric current for a time of from 10 seconds to 5 minutes.

20. A method as claimed in claim 15 wherein the substrate is selected from the group steel, zinc, brass, copper, nickel, tin, alloyed gold, silver, cadmium, chromium and stainless steel.

21. A method as claimed in claim 15 wherein the chromite coating is from 100 Angstroms to 1 micron thick.

22. An electrolyte as claimed in claim 14 containing one or more conductivity salts including at least one cation selected from the group $NH_4^+$, $K^+$, $Na^+$, $Mg^{2+}$ and $Ca^{2+}$ at a concentration of at least 0.5 molar.

23. An electrolyte as claimed in claim 22 wherein the concentration of the conductivity salt or salts is from 2 to 6 molar.

24. An electrolyte as claimed in claim 14 wherein the molar ratio of the concentration of the glycine to $Cr^{III}$ ions is from 0.1:1 to 6:1.

25. An electrolyte as claimed in claim 14 containing boric acid at a concentration of from 1 $gl^{-1}$ to saturation.

26. An electrolyte as claimed in claim 14 wherein the concentration of the poison is from 1 to 15 $gl^{-1}$.

* * * * *